US010442073B2

(12) United States Patent
Brauer et al.

(10) Patent No.: US 10,442,073 B2
(45) Date of Patent: Oct. 15, 2019

(54) ROTATING HANDLE AND RELATED METHODS

(71) Applicants: Kenneth J. Brauer, Elkhorn, WI (US); Scott J. Emmerich, Delavan, WI (US)

(72) Inventors: Kenneth J. Brauer, Elkhorn, WI (US); Scott J. Emmerich, Delavan, WI (US)

( * ) Notice: Subject to any disclaimer, the term of this patent is extended or adjusted under 35 U.S.C. 154(b) by 36 days.

(21) Appl. No.: 15/295,788

(22) Filed: Oct. 17, 2016

(65) Prior Publication Data

US 2017/0106525 A1 Apr. 20, 2017

Related U.S. Application Data

(60) Provisional application No. 62/242,637, filed on Oct. 16, 2015.

(51) Int. Cl.

| | |
|---|---|
| ***B25G 1/06*** | (2006.01) |
| ***B25G 3/20*** | (2006.01) |
| ***B25D 17/04*** | (2006.01) |
| ***B25G 3/26*** | (2006.01) |
| ***B25F 5/02*** | (2006.01) |

(52) U.S. Cl.

CPC ..... *B25G 1/06* (2013.01); *B25D 17/046* (2013.01); *B25F 5/026* (2013.01); *B25G 3/20* (2013.01); *B25G 3/26* (2013.01); *Y10T 16/4713* (2015.01)

(58) Field of Classification Search

CPC ... Y10T 16/469; Y10T 16/4713; A01B 1/026; B25D 17/04; B25D 17/043; B25D 17/046; B25F 5/024; B25F 5/026; B25G 1/01; B25G 3/20; B25G 3/26; B25G 1/06; B25G 1/102

USPC ..... 16/422, 426

See application file for complete search history.

(56) References Cited

U.S. PATENT DOCUMENTS

| | | | | | |
|---|---|---|---|---|---|
| 237,891 | A * | 2/1881 | Musselman | B25G 1/00 | 16/426 |
| 1,257,799 | A * | 2/1918 | Brown | G05G 1/12 | 16/422 |
| 1,945,430 | A * | 1/1934 | Garrett | A01B 1/225 | 16/426 |
| 2,134,020 | A * | 10/1938 | Anson | B62D 1/043 | 16/426 |
| 2,410,882 | A * | 11/1946 | Lansden | A01D 1/14 | 16/110.1 |
| 3,341,235 | A * | 9/1967 | Mattson | A01D 34/84 | 16/426 |
| 4,881,294 | A * | 11/1989 | Riedl | B25F 5/003 | 16/426 |
| 5,230,154 | A * | 7/1993 | Decker | B26B 25/002 | 16/422 |

(Continued)

*Primary Examiner* — Jeffrey O'Brien

(74) *Attorney, Agent, or Firm* — Fitch, Even, Tabin & Flannery LLP

(57) ABSTRACT

Rotatable handles and related methods are disclosed herein. In one form, the handle has a first clamp member, a second clamp member connected to the first clamp member on one end and mating with the first clamp member at another end, and an actuator operable to drive the mated ends of the first clamp member and second clamp member together to create a clamping force between the first clamp member and the second clamp member and secure the rotatable handle into a fixed position with respect to an object to which the rotatable handle is connected. Various methods are also disclosed herein with respect to the rotatable handle.

9 Claims, 12 Drawing Sheets

(56) References Cited

U.S. PATENT DOCUMENTS 5,352,060 A * 10/1994 Poetker ..... B25G 1/00 16/422
5,625,922 A * 5/1997 Morad ..... A46B 17/02 16/426
6,814,156 B2 * 11/2004 Dieterle ..... B25F 5/026 16/110.1
6,928,945 B1 * 8/2005 Tebo, Jr. ..... B63B 21/00 114/230.15
7,137,542 B2 * 11/2006 Oki ..... B25D 17/043 173/162.2
7,611,413 B2 * 11/2009 Ryan ..... A61F 5/37 119/801
7,823,256 B2 * 11/2010 Engelfried ..... B25D 17/04 16/426
8,032,990 B2 * 10/2011 Shinma ..... B25D 17/04 16/426
8,132,296 B2 * 3/2012 Di Nicolantonio ..... B25F 5/026 16/426
8,166,614 B2 * 5/2012 Martin ..... B25F 5/026 16/422
8,186,018 B2 * 5/2012 Martin ..... B25F 5/026 16/422
8,256,528 B2 * 9/2012 Oesterle ..... B25F 5/026 173/162.1
8,342,705 B2 * 1/2013 Yaksich ..... B25F 5/021 362/109
8,407,860 B2 * 4/2013 Brennenstuhl ..... B25F 5/026 16/422
8,621,719 B2 * 1/2014 Nakashima ..... B25F 5/006 16/422
8,914,947 B2 * 12/2014 Weiss ..... B25D 17/043 16/426
9,308,638 B2 * 4/2016 Kondo ..... B25F 5/02
9,314,913 B2 * 4/2016 Ikuta ..... B23Q 11/0046
9,463,566 B2 * 10/2016 Yoshikane ..... B25F 5/02
9,498,876 B2 * 11/2016 Schubert ..... B25F 5/026
9,507,371 B1 * 11/2016 Day ..... G05G 1/54
9,775,272 B1 * 10/2017 Gilbert ..... A01B 1/026
2004/0163214 A1 * 8/2004 Cheng ..... B23D 51/01 16/426
2007/0209162 A1 * 9/2007 McRoberts ..... B25F 5/026 16/426
2008/0078067 A1 * 4/2008 Nicolantonio ..... B25F 5/006 16/426
2010/0115730 A1 * 5/2010 Holland ..... B25G 1/102 16/422
2011/0011609 A1 * 1/2011 Simm ..... B25D 17/04 173/171
2011/0173778 A1 * 7/2011 Wales ..... B25G 3/20 16/426
2014/0020210 A1 * 1/2014 Brennenstuhl ..... B25F 5/026 16/426
2014/0259533 A1 * 9/2014 Day ..... B25G 3/20 16/426
2016/0129579 A1 * 5/2016 Friedrich ..... B25F 5/026 173/162.2
2016/0250740 A1 * 9/2016 Ikuta ..... B23Q 11/0046 173/198
2017/0252833 A1 * 9/2017 Bayona Salazar .... B23B 49/008
2017/0312904 A1 * 11/2017 Wiedner ..... B25F 5/026
2018/0050447 A1 * 2/2018 Geiger ..... B25F 5/026

* cited by examiner

UNLOCKED

LOCKED

ROTATING HANDLE AND RELATED METHODS

CROSS-REFERENCE TO RELATED APPLICATION

This application claims the benefit of U.S. Provisional Application No. 62/242,637, filed Oct. 16, 2015, and is incorporated herein by reference in its entirety.

FIELD OF THE INVENTION

This invention relates generally to a handle assemble, and more specifically, to a rotating handle assembly.

BACKGROUND OF THE INVENTION

There exist many applications in which the ability to quickly and easily install, uninstall, and reorient/reposition/rotate a handle about a cylindrical body exist. For example, operators of a tactical rifle may find that different circumstances call for different orientations of a fore grip of the tactical rifle. Unfortunately, many conventional systems only allow the operator to move a fore grip handle forward and rearward, unless the fore grip is removed from the rifle. If the operator wishes to change the orientation of the fore grip, the operator must remove the fore grip from a rail system (e.g., a Picatinny rail system) featured on the tactical rifle and reposition the fore grip. Not only is this time consuming and relatively difficult, but the operator is forced to choose an orientation from a small number of predetermined positions (e.g., four positions spaced approximately at 90° intervals) provided by the rail system.

Other conventional systems include a base for sliding forward and rearward on the Picatinny rail in a horizontal direction and having a handle that is rotatable about a generally vertical rotation axis, such as one extending through the longitudinal axis of the handle itself, which results in the handle being rotatable about the vertical axis within a common horizontal plane, but this still fails to give the user the ability to rotate the handle into a position that may be more comfortable for the user, such as about a generally horizontal rotation axis. Similarly, such handles cannot be quickly or easily removed, re-installed and/or reoriented with respect to a body let alone a body already having other accessories attached thereto.

Consequently, a need exists for a handle that can be quickly installed, uninstalled, and reoriented/repositioned/rotated about a cylindrical body.

BRIEF DESCRIPTION OF THE DRAWINGS

Embodiments of the invention are illustrated in the figures of the accompanying drawings in which.

Figure 1:
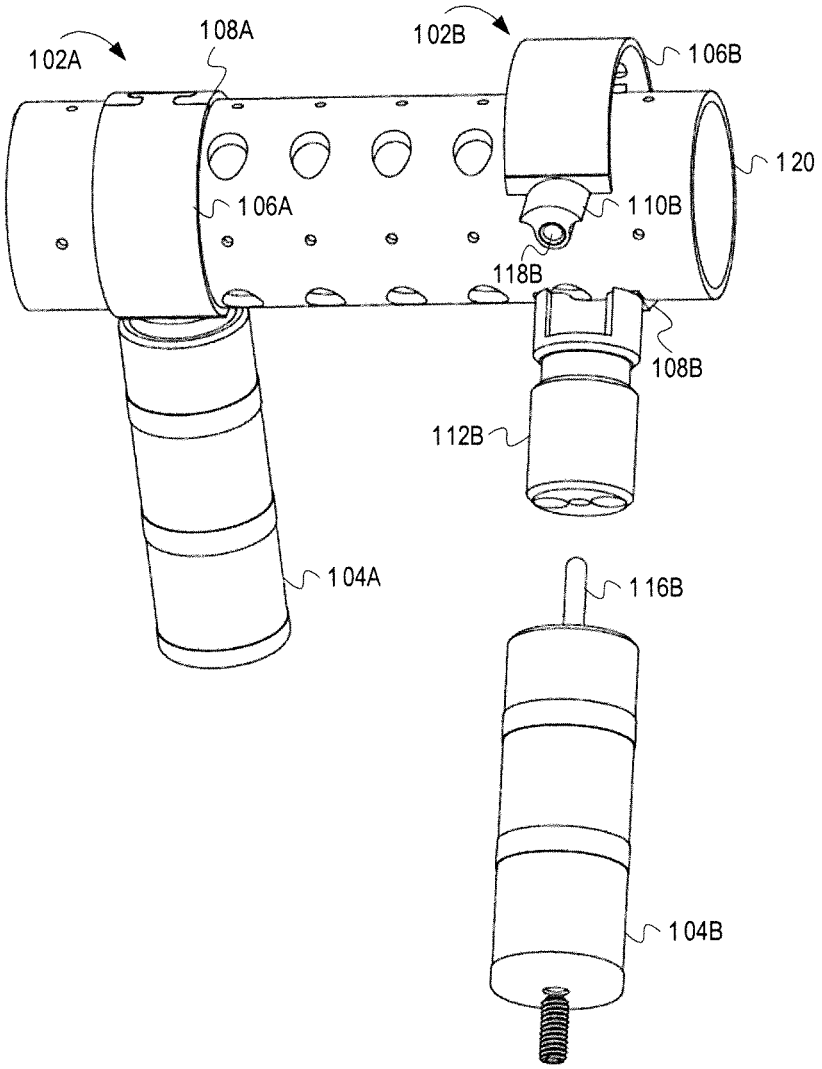
FIG. 1 depicts two handle assemblies 102A/102B in accordance with one form of the invention disclosed herein connected to a handguard of a weapon, with the first handle assembly 102A illustrating the handle fully connected to the handguard and the second handle assembly 102B being partially exploded in order to illustrate how the handle assembly is connected to the handguard.

Elements in the figures are illustrated for simplicity and clarity and have not necessarily been drawn to scale or to include all features, options, or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Embodiments of the inventive subject matter are disclosed herein and include in at least one form a rotatable handle assembly comprising a cuff and a handle. The cuff wraps around a cylindrical body and comprises two split ring portions (also referred to herein as "clamp members").

The split ring portions can be removably or irremovably attached at a top portion of the cuff. In some embodiments, this configuration allows for 360° rotation of the handle assembly about the cylindrical body. The handle can be manipulated to move a pin that interacts with an aperture disposed into an end of one of the two split ring portions. For example, when the handle is rotated clockwise, the pin is forced upward into the aperture creating a clamping force between the two split ring portions. In such embodiments, the handle assembly can be quickly locked and unlocked from the cylindrical body and repositioned easily in any angular position and any fore/aft position on the cylindrical body. Thus, in some forms, the handle assembly can easily be rotated about a first longitudinal axis running through the cylindrical body as well as moved fore and aft along the first longitudinal axis running through the cylindrical body making the handle assembly two-way adjustable. In addition, in some embodiments the handle can also be adjusted in a third manner in which the orientation of the handle itself can be adjusted to be secured into a desired orientation about a second longitudinal axis running through the handle, thus, making the handle assembly three-way adjustable. For example, in some forms, the handle may have a predetermined grip pattern and a user may desire to change the orientation of the grip pattern about the second longitudinal axis running through the handle itself. In one form, a second adjustable pin is provided that can be adjusted to allow for such changes to the orientation of the grip. The following figures and description provide further details relating to embodiments of the inventive subject as well as methods for using embodiments of the inventive subject matter.

FIG. 1 depicts two handle assemblies 102A/102B, according to some embodiments of the inventive subject matter. The handle assemblies 102A/102B are the same handle assembly but are depicted side-by-side in differing configurations or states of assembly to present aspects of the inventive subject matter more clearly. The first handle assembly 102A is depicted in an assembled configuration and the second handle assembly 102B is depicted in a partially disassembled configuration. The handle assembly 102A/102B is operable to mount to a cylindrical object, such as a tube 120. The handle assembly 102A/102B utilizes a split ring design, best depicted in FIG. 5, in which a cuff of the handle assemble 102A/102B is comprised of two semicircular portions (i.e., a first split ring portion 106A/106B and a second split ring portion 108A/108B). It should be understood, however, that in alternate embodiments the clamp members 106A/106B and 108A/108B could take any shape that allows the two items to be clamped together around an object. Thus, the handle assemblies 102A/102B may be used on objects other than cylindrical objects (such as posts, tubes, columns, etc.), such as rectangular structures, triangular structures, oval structures, etc.

Turning back to the embodiment of FIG. 1, the handle assembly 102A/102B generally includes a handle 104A/104B, the first clamp portion or split ring portion 106A/106B, the second clamp portion or split ring portion 108A/108B, an actuator (e.g., a pin 116B, as depicted in the one handle 102B where it is visible in FIG. 1), and a threaded body 112B. The first clamp member or split ring portion 106A/106B, has a first end, such as split ring portion end 110B, that includes a receiver or pocket 118B. The handle 104A/104B is configured to house the threaded body 112B such as by having internal threading to engage or mate with the external threading of threaded body 112B when the handle assembly 102A/102B is in the assembled position. When the handle assembly 102A/102B is in the assembled position, the pin 116B extends through the threaded body 112B and into the receiver or pocket 118B. Engagement between the pin 116B and the receiver or pocket 118B causes a clamping force between the first clamp portion 110B and the second clamp portion 108B and thus removably secures the handle assembly 102A/102B to the tube 120. In the form illustrated, the tube or cylinder 120 illustrated is a handguard for a firearm, such as an AR-10 rifle or the like.

In some embodiments, the receiver or pocket 118B is designed as an offset recess or aperture with which the pin 116B interacts or within which the pin 116B is disposed. For example, the receiver or pocket 118B can be biased out of alignment with the pin 116B. As the pin 116B protrudes further into the receiver or pocket 118B, the receiver or pocket 118B is further centered about the pin 116B. Thus, a clamping force between the first split ring portion end 110B and second split ring portion end increases as the pin 116B protrudes further into the receiver or pocket 118B. In one form, the threaded body 112B is externally threaded and at least a portion of the handle 104A/104B is internally threaded such that the threaded body 112B can mate with the portion of the handle 104A/104B that is internally threaded. In such forms, an operator can control the depth at which the pin 116B protrudes into the receiver or pocket 118B by rotating the handle 104A/104B about an axis parallel to the pin 116B (i.e., "screwing" the handle on). Put simply, a user can manipulate the clamping force by rotating the handle 104A/104B. In some embodiments, the positioning of the receiver or pocket 118B and/or the pin 116B is such that it is not necessary to remove the handle assembly 102A/102B from the tube 120 to rotate the handle assembly 102A/102B about the tube 120. Rather, "loosening" or "unscrewing" the handle 104A/104B decreases the clamping force an amount sufficient to allow the operator to rotate the handle assembly 102A/102B about the tube 120.

While FIG. 1 and the associated text provide a brief overview of a handle assembly according to some embodiments of the inventive subject matter, the remaining FIGS. 2-5 and associated text provide further detail and explanation of a preferred form of a handle assembly in accordance with aspects of the invention disclosed herein. For convenience, items in FIGS. 2-5 that are similar to those discussed above with respect to FIG. 1 will be referenced using the same latter two-digit reference numeral but having the prefix "2" instead of "1". Thus, the handle assembly is referred to generally as assembly 202 and is similar to embodiments 102A/102B discussed above.

Figure 2:
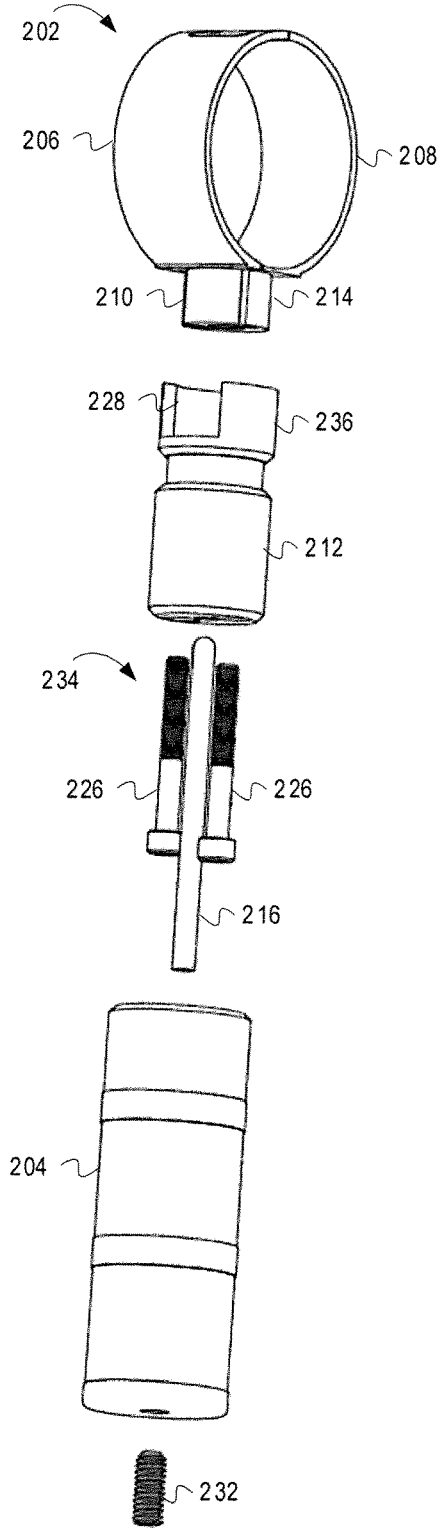
FIG. 2 depicts an exploded view of one form of handle assembly 202, according to some embodiments of the inventive subject matter.

FIGS. 2-5 depict several components of a handle assembly 202, according to some embodiments of the inventive subject matter. In FIG. 2, the handle assembly 202 includes a first split ring portion 206 and a second split ring portion 208 (collectively referred to as a "cuff"), a threaded body 212, a pin assembly 234, and a handle 204.

The first split ring portion 206 includes a first split ring portion end 210. The second split ring portion includes a second split ring portion end 214. The first split ring portion end 210 and the second split ring portion end 214 are configured to mate with one another. For example, as depicted in FIG. 2, the first split ring portion end 210 includes a protrusion and the second split ring portion end 214 includes a recess complimentary to the protrusion. Additionally, the first split ring portion end 210 includes a receiver pocket (best seen as indicated by reference numeral 218 in FIG. 4). In some embodiments, the second split ring portion end 214 can include recesses (see reference numerals 230 in FIG. 4) in addition to the receiver pocket.

The threaded body 212 includes a receptacle such as a threaded body cup 236. The threaded body cup 236 is configured to receive the first split ring portion end 210 and the second split ring portion end 214. In one form, the threaded body cup 236 includes a threaded body cup opening 228. The threaded body cup opening 228 allows an operator to place at least a portion of the first split ring portion end 210 and the second split ring portion end 214 in the threaded body cup 236 during assembly. In the embodiment illustrated, the threaded body 212 is externally threaded and the threaded body cup opening 228 has an upper or longitudinal opening and an adjacent side or lateral opening that corresponds in shape to the shape of the split ring portion ends 210 and 214. More particularly, in the form illustrated, the side or lateral opening of the threaded body cup 236 corresponds in shape to the shape of the first split ring portion end 210 to allow this end to rotate into the threaded body cup 236 and then be secured and clamped within same by threading handle housing 204 over the threaded body 212 including threaded body cup portion 236.

Figure 4:
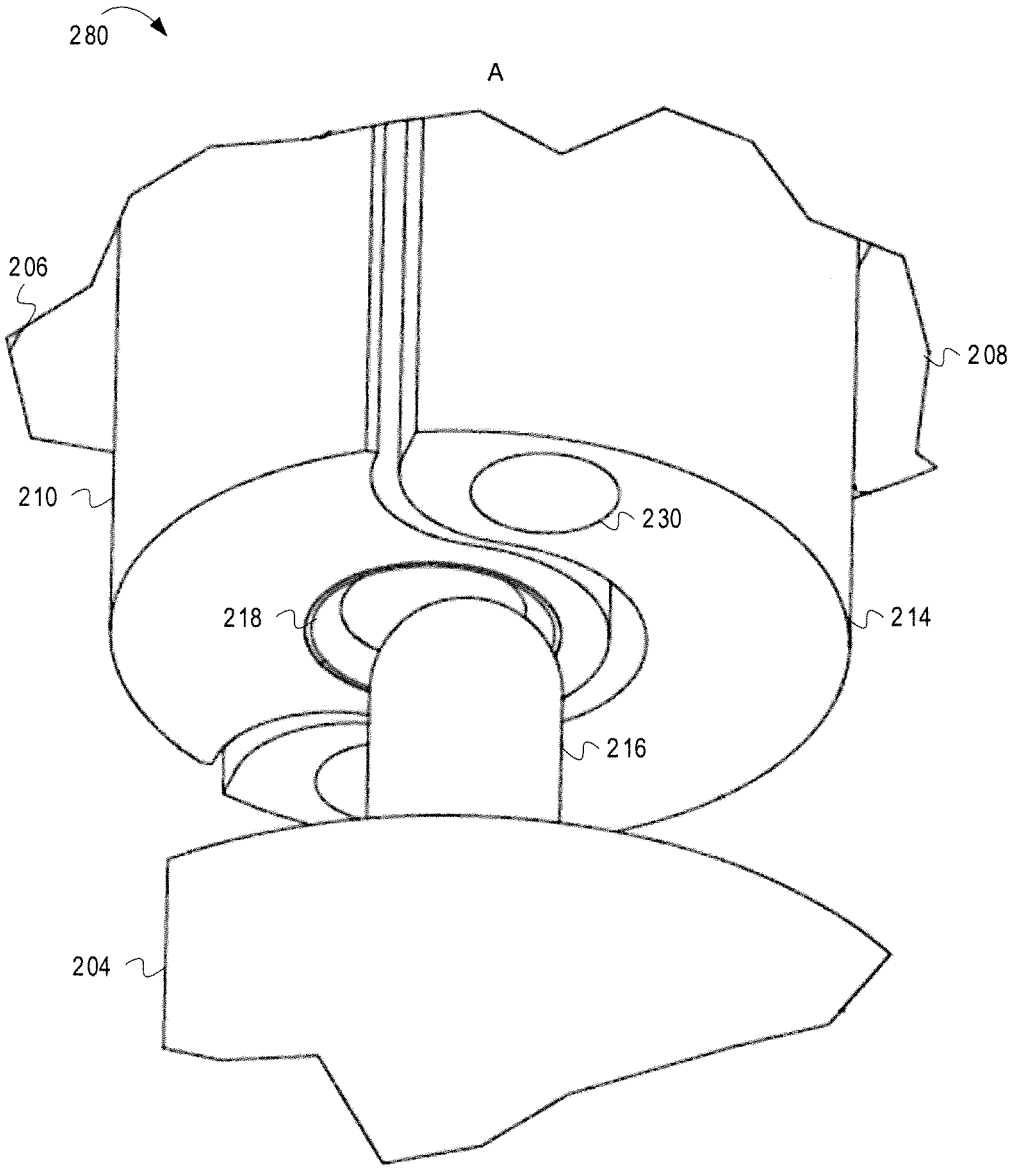
FIG. 4 depicts a perspective view of an enlarged portion 280 (portion "A") of the handle assembly of FIG. 3.

The pin assembly 234 includes a protrusion, such as indexing pin 216. The pin assembly 234 is configured to seat within the threaded body 212. In the form illustrated, the pin 216 extends through the externally threaded body via a central aperture or opening so that an upper portion of the pin 216 is able to interact with the receiver pocket 218 such as by protruding into the receiver pocket 218. A lower portion of the pin 216 interacts with the handle 204, as further described below. In some embodiments, the pin assembly 234 includes secondary protrusions such as bolts or pins 226. The recesses 230 (as seen in FIG. 4) of the second split ring portion end 214 are each configured to receive one of the secondary pins 226. Interaction between the secondary pins 226, the second split ring portion 214, and the pin 216 can cause a clamping force between the first split ring portion 206 and the second split ring portion 208. Additionally, in some embodiments, interaction between the secondary pins 226 and the recesses prevent the threaded body 212 from rotating about the first split ring portion end 210 and the second split ring portion end 214. Additionally, in one form, the secondary pins 226 can be used to secure the threaded body 212 to the second split ring portion 214 and indirectly connecting the handle 204 to the second split ring portion 214. More particularly, by using secondary pins 226 to secure the externally threaded body 212 to the second clamp member 214, the handle 204 is rotatable about threaded body 212 and movable between a first released position wherein the handle 204 is lowered or moved away from the clamp members 206, 208 to allow the first split ring portion end 210 to be moved into or removed from the side facing opening 228 of threaded body cup 236 and a second secured position wherein the handle 204 is raised or moved toward the clamp members 206, 208 to allow at least a portion of the handle 204 to close or reduce the size of the side facing opening 228 of cup 236 to prevent the first split ring portion end 210 from being removed from threaded body cup 236. As the handle 204 is continued to be moved toward the clamp members 206, 208, the handle 204 drives the pin 216 further into engagement with the receiver pocket 218 of the first split ring portion end 210 and exerts a stronger clamping force between first and second split ring portion ends 210 and 214, respectively.

Turning back to FIGS. 2-5, the handle 204 is configured to receive the threaded body 212. In some embodiments, the handle 204 is internally threaded such that the internal threads of the handle 204 mate with the external threads of the threaded body 212. As previously discussed, the handle 204 is configured to interact with the lower portion of the pin 216. Such interaction forces the pin 216 into the receiver pocket 218 thus producing a clamping force between the first split ring portion end 210 and the second split ring portion end 214. In some embodiments, the handle 204 includes a biasing member, such as a set screw 232. The set screw 232 can manipulate the interaction between the handle 204 and the pin 216. For example, the operator can utilize the set screw 232 to adjust the amount that the pin 232 protrudes beyond the threaded body 212. It should be understood, however, that in alternate embodiments the threading of the handle 204 and body 212 could be inverted so that the body 212 is internally threaded and the handle 204 externally threaded. In yet other embodiments, both the handle 204 and body 212 may each contain internally and externally threaded portions that correspond with and allow the handle and body to engage one another and be movable with respect to one another to cause the handle to exert or release a clamping force between the first and second ring clamp member ends 210 and 214.

Figure 3:
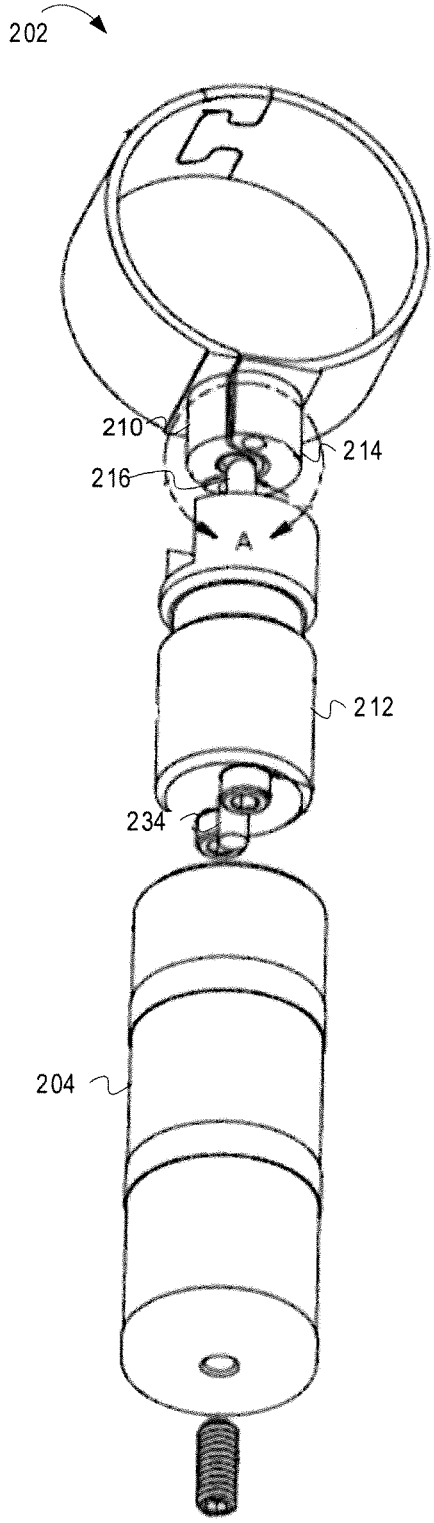
FIG. 3 is a perspective view of the handle assembly 202 of FIG. 2 illustrating the handle assembly in a semi-assembled state and in accordance with some embodiments of the inventive subject matter.

FIG. 3 is a perspective view of a handle assembly 202 in a semi-assembled state, according to some embodiments of the inventive subject matter. In FIG. 3, the pin assembly 234 is inserted into the threaded body 212. The pin 216 extends beyond the threaded body 212. The pin 216 mates with the receiver pocket 218 to cause a clamping force between the first split ring portion end 210 and the second split ring portion end 214. An expanded portion "A" of FIG. 3 is provided in FIG. 4 to better show the interaction between the pin 216 and the receiver pocket 218.

More particularly, FIG. 4 depicts an expanded portion 280 (portion "A" of FIG. 3) of a handle assembly, according to some embodiments of the inventive subject matter. As previously discussed, the first split ring portion end 210 and the second split ring portion end 214 are configured to mate with one another. Forcing the first split ring portion end 210 and the second split ring portion end 214 to contact one another aligns the receiver pocket 218 and the pin 216. In some embodiments, the receiver pocket 218 is designed to guide the pin 216 into the receiver pocket 218. For example, as depicted in FIG. 4, the receiver pocket 218 includes a beveled, bell mouthed or chamfered edge. Although the receiver pocket 218 is depicted with a chamfered edge, any suitable configuration of the receiver pocket 218 can be used. For example, the receiver pocket 218 could be a conical, frustoconical, or domed aperture. In addition to, or in lieu of a receiver pocket 218 designed to guide the pin 216 into the receiver pocket 216, the pin 216 can be formed to encourage entry of the pin 216 into the receiver pocket 218. For example, the pin 216 can include a domed or pointed tip.

Figure 5:
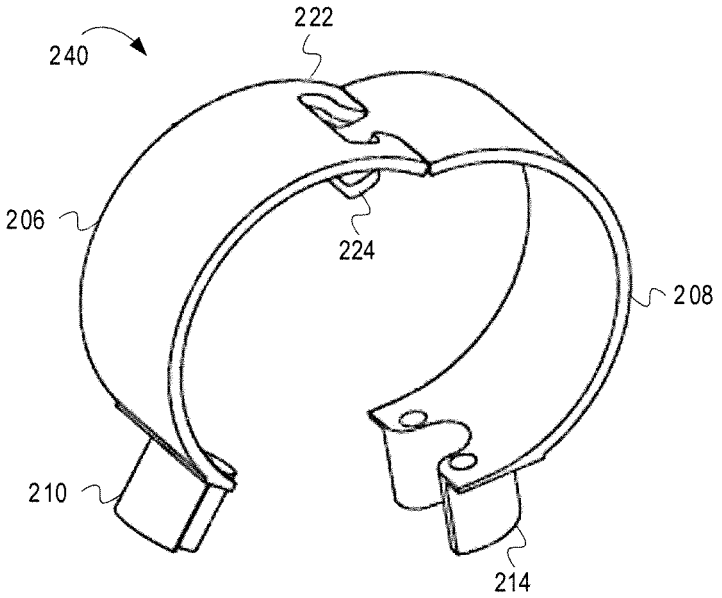
FIG. 5 depicts exemplary forms of the mating structures for mating the first split ring portion 206 and the second split ring portion 208 of the handle assembly 202 depicted in FIG. 2 in greater detail.

FIG. 5 depicts a first split ring portion 206 and a second split ring portion 208 (collectively referred to as a "cuff" or clamp members) of a handle assembly 202, according to some embodiments of the inventive subject matter. As previously discussed, the handle assembly utilizes a split ring design which includes the first split ring portion 206 and the second split ring portion 208. The first split ring portion 206 includes a first mating member 222 located opposite the first split ring portion end 210. The second split ring portion 208 includes a second mating member 224 located opposite the second split ring portion end 214. The first mating member 222 and the second mating member 224 are configured to mate with one another (e.g., via a keyed engagement) to secure the first split ring portion 206 to the second split ring portion 208. In some embodiments, the first split ring portion 206 and the second split ring portion 208 can be physically separated from one another. Such a configuration is advantageous in environments in which the cylindrical object with which the handle assembly is to be used includes elements on its surface (e.g., rails, fasteners, etc.). FIG. 5 depicts one such embodiment. In FIG. 5, the first mating member 222 and the second mating member 224 are depicted as complimentary pieces, however any suitable mating structures can be used. In other embodiments, the first split ring portion 206 and the second split ring portion 208 may be separate pieces that cannot be separated from one another. For example, the first split ring portion 206 and the second split ring portion 208 can be connected via a hinge. Thus, this configuration allows the handle 204 to be rotated about a generally horizontal rotation axis which results in the handle 204 being rotatable to different degrees or angles within a common vertical plane as well as remaining rotatable in a generally vertical rotation axis wherein the handle 204 can be rotated to different degrees or angles within a common horizontal plane. While in the form illustrated, the handle 204 is cylindrical and thus does not have grip oriented for a particular hand positioning, it should be understood that even with such handles (e.g., handles with grip oriented for a specific hand positioning), the handle still remains rotatable about a generally vertical rotation axis as well because where, but this still fails to give the user the ability to rotate the handle in to a position that may be more comfortable for the user, such as about a generally horizontal rotation axis. Similarly, such handles cannot be quickly or easily removed, re-installed and/or reoriented with respect to a body.

Figure 6:
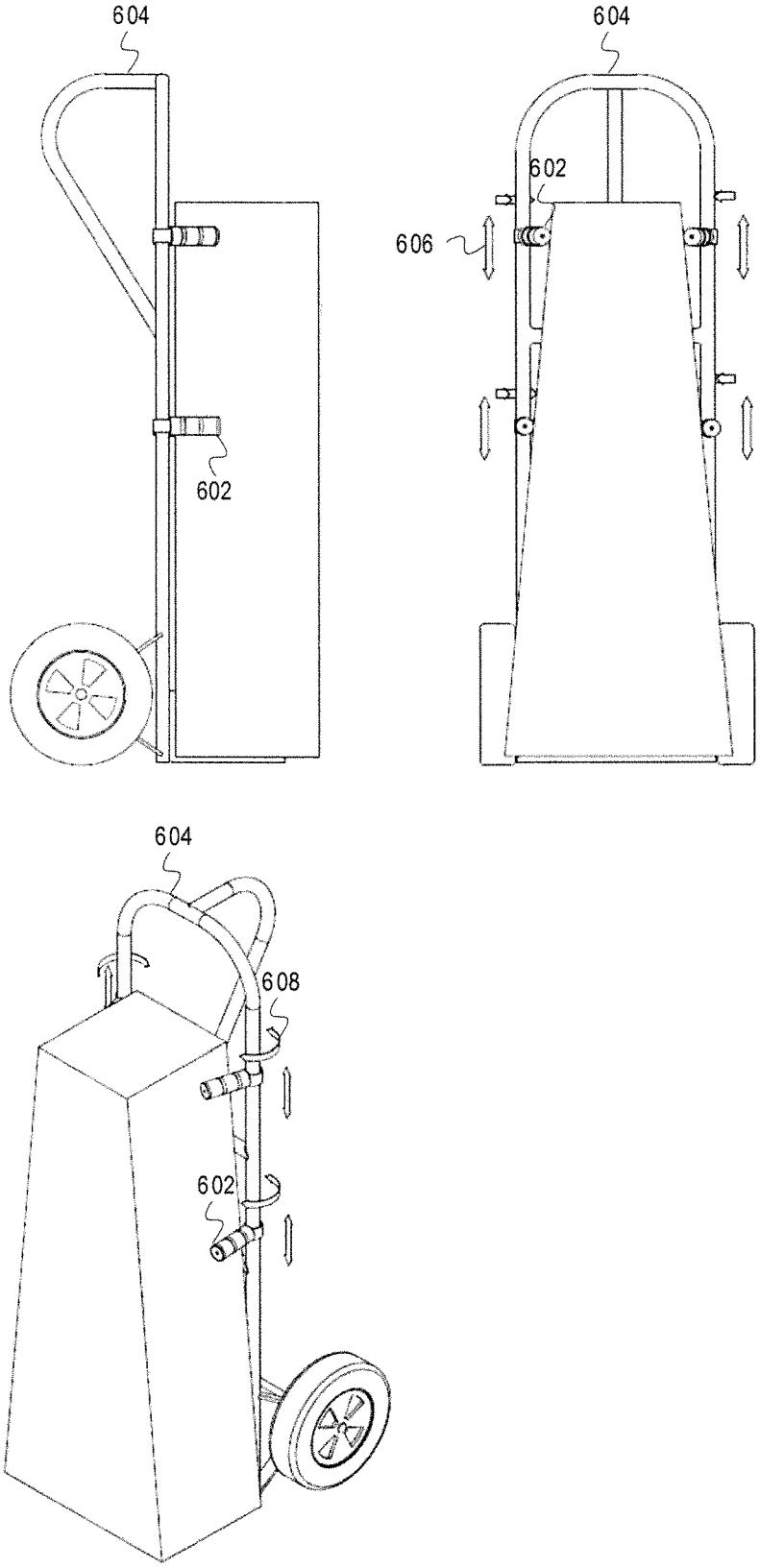
FIG. 6 depicts a cart 604 with at least one rotatable handle assembly 602, according to some embodiments of the inventive subject matter.

While a rotatable handle assembly has been discussed thus far, it should be understood that such a feature can be implemented in many different types of products and that those end products are contemplated as inventions disclosed herein. For example, FIG. 6 depicts a cart 604 with one or more rotatable and/or detachable or removable handle assemblies 602, according to some embodiments of the inventive subject matter. As depicted in FIG. 6, the handle assembly 602 is secured about a support member of cart 604, such as the frame of a dolly. The handle assembly 602 can be tightened and loosened as described throughout this specification. When loosened, the handle assembly 602 can be moved up and down, as indicated by arrow 606, and rotated, as indicated by arrow 608. Further, the position of the handle can be altered (e.g., repositioned, reorientated, etc.) as desired by adjusting the second actuator (e.g., second pin or biasing member (like pin or screw 232 discussed above)). In this way, if the outer handle of the handle assembly (which has previously been referenced as 104 and 204 in earlier embodiments) has a distinct grip pattern intended to be gripped in a desired manner, then the second pin can be adjusted as needed to ensure the grip is in the desired orientation when tightened onto the handle assembly. While a plurality of such handle assemblies are shown, it should be understood that in alternate forms the cart may include one or more of such handles as desired.

Figure 7:
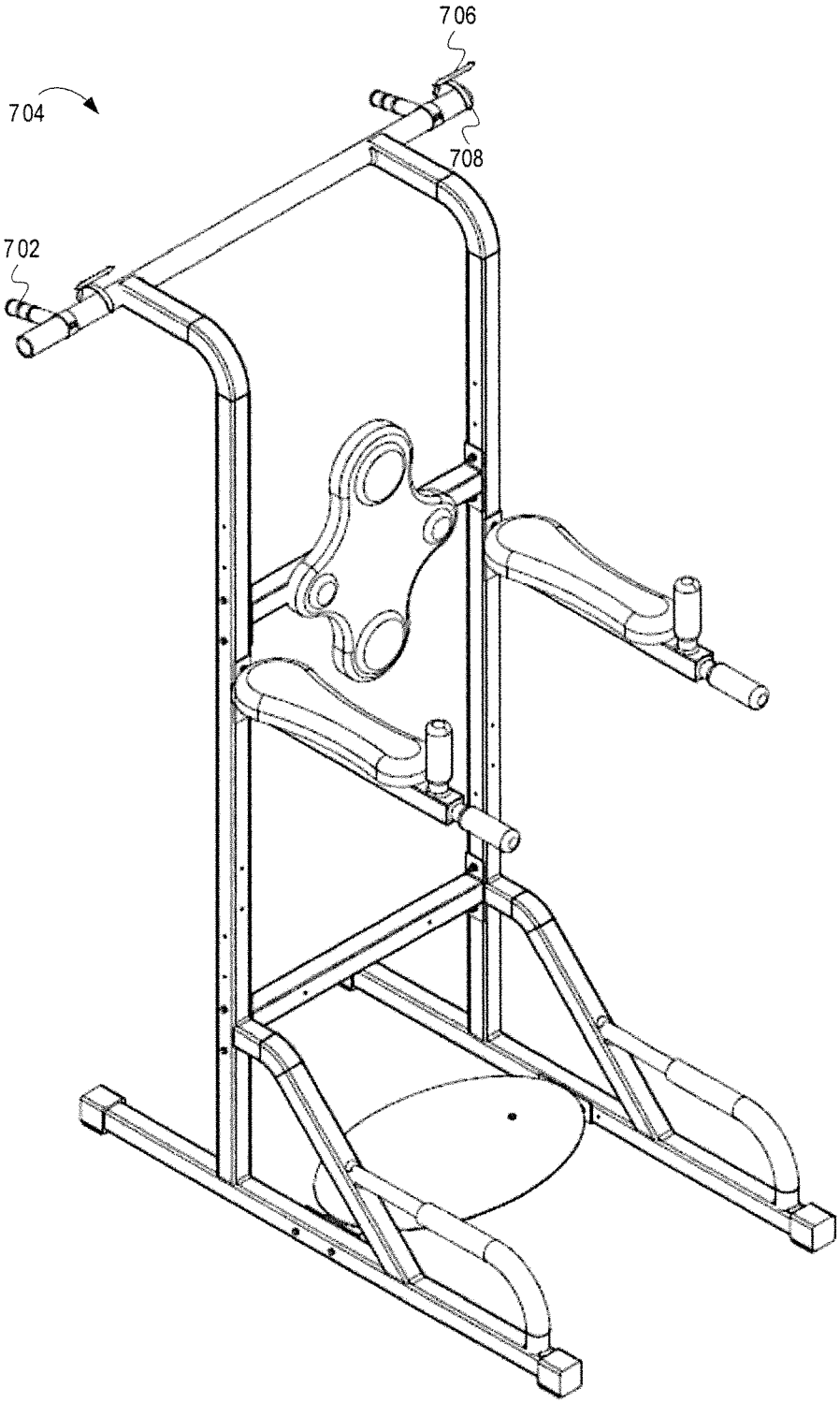
FIG. 7 depicts fitness equipment 704 with at least one rotatable handle assembly 702, according to some embodiments of the inventive subject matter.

FIG. 7 depicts fitness equipment 704 including a rotatable and/or removable handle assembly 702, according to some embodiments of the inventive subject matter. As depicted in FIG. 7, the handle assembly 702 is secured about a bar of the fitness equipment 704. The handle assembly 702 can be tightened and loosened, repositioned and/or reorientated as described throughout this specification. When loosened, the handle assembly 702 can be moved up and down, as indicated by arrow 706, and rotated, as indicated by arrow 708. Further the grip of the handle can be repositioned or reoriented as disclosed herein. In addition, the handle 702 may be removed from, and repositioned on, the equipment as desired with minimal disruption to the equipment or accessories mounted to same and, like cart 604, fitness equipment 704 may be provided with one or more of such handle assemblies as desired (e.g., it may have a single handle assembly or a plurality of handle assemblies).

Figure 8:
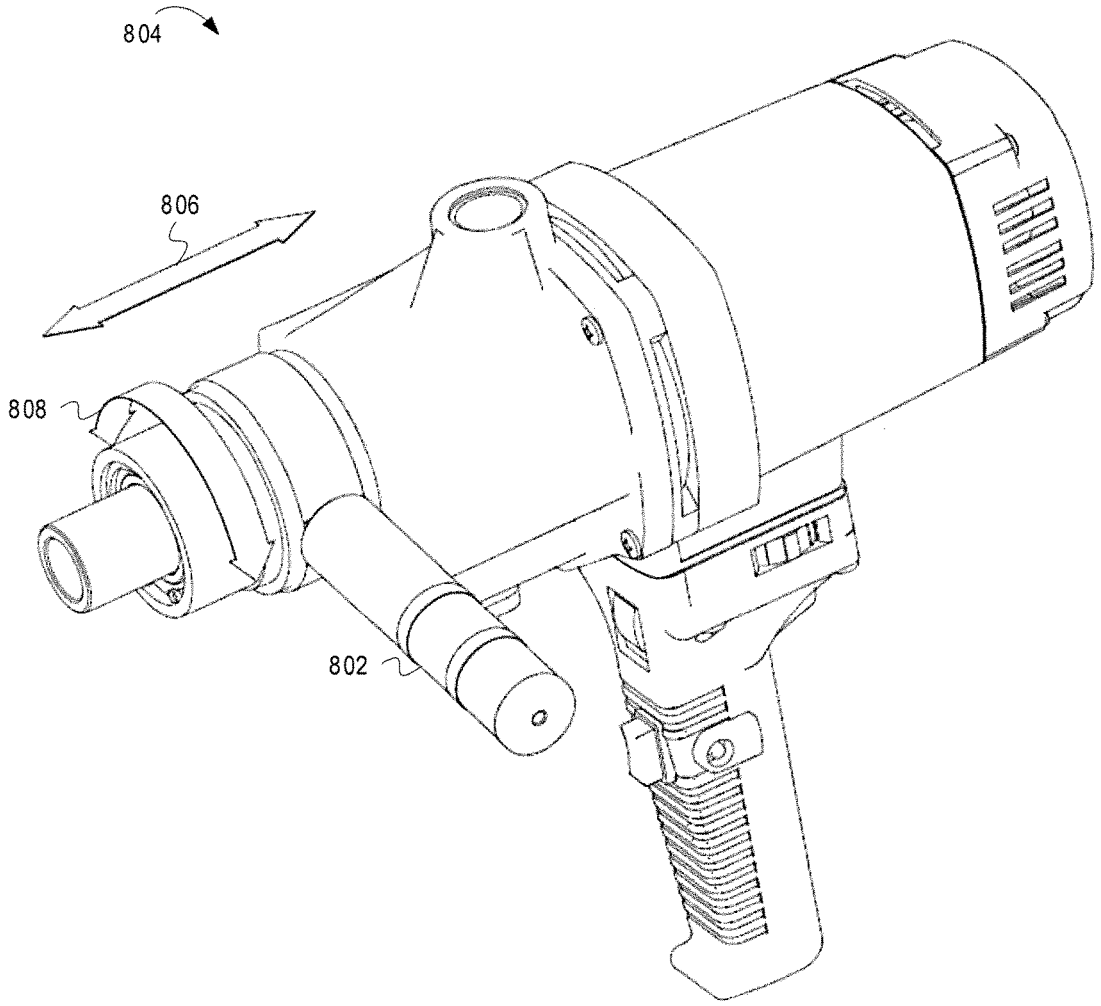
FIG. 8 depicts a power tool, such as drill 804, with at least one rotatable handle assembly 802, according to some embodiments of the inventive subject matter.

FIG. 8 depicts a tool, such as a power tool like a drill or hammer drill 804, with a rotatable and/or removable handle assembly 802, according to some embodiments of the inventive subject matter. As depicted in FIG. 8, the handle assembly 802 is secured on a forward portion of the drill 802 behind the chuck. The handle assembly 802 can be tightened and loosened, repositioned or reoriented, or removed from and placed on the power tool as described throughout this specification. When loosened, the handle assembly 802 can be moved up and down, as indicated by arrow 806, and rotated, as indicated by arrow 808. Further the grip of the handle can be repositioned or reoriented as disclosed herein. In addition, the handle 802 may be removed from and repositioned on the power tool as desired with minimal disruption to the power tool or accessories used with same and, like cart 604 and fitness equipment 704, power tool 804 may be provided with one or more of such handle assemblies as desired (e.g., it may have a single handle assembly or a plurality of handle assemblies).

Figure 9:
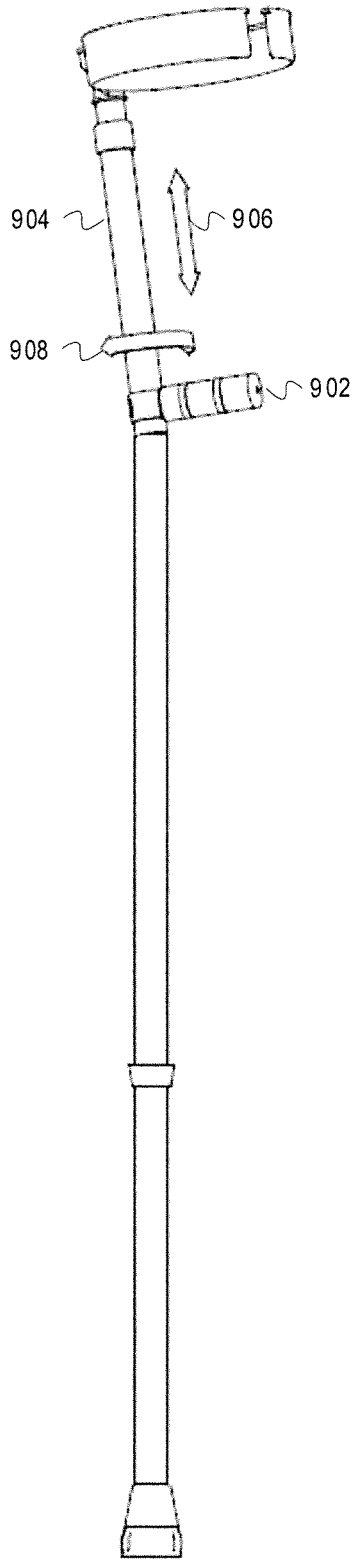
FIG. 9 depicts a medical aid, such as a cane, crutch or brace 904, with at least one rotatable handle assembly 902, according to some embodiments of the inventive subject matter.

FIG. 9 depicts use of a mobility aid 904, such as a walking aid (e.g., crutch, brace, cane, etc.) with handle assembly 902, according to some embodiments of the inventive subject matter. As depicted in FIG. 9, the handle assembly 902 is secured about the brace or cane 904. The handle assembly 902 can be tightened, loosened, repositioned, installed on or removed from the brace or cane 904 as described throughout this specification. When loosened, the handle assembly 902 can be moved up and down, as indicated by arrow 906, and rotated, as indicated by arrow 908. Further the grip of the handle can be repositioned or reoriented as disclosed herein. In addition, the handle 902 may be removed from and repositioned on the brace or can 904 as desired with minimal disruption to the brace or cane or accessories used with same and, like cart 604, fitness equipment 704 and power tool 804, brace or cane 904 may be provided with one or more of such handle assemblies as desired (e.g., it may have a single handle assembly or a plurality of handle assemblies).

In addition to the above embodiments, it should be understood that various methods are also disclosed herein such as methods for manufacturing and providing a rotatable and/or removable handle, methods of securing a handle to an object, methods of providing a repositionable or reorientatable handle that can be adjusted in at least two, and in some forms three, directions and/or along at least two separate axes of rotation and/or in two different planes along one of those axes of rotation.

Figure 10:
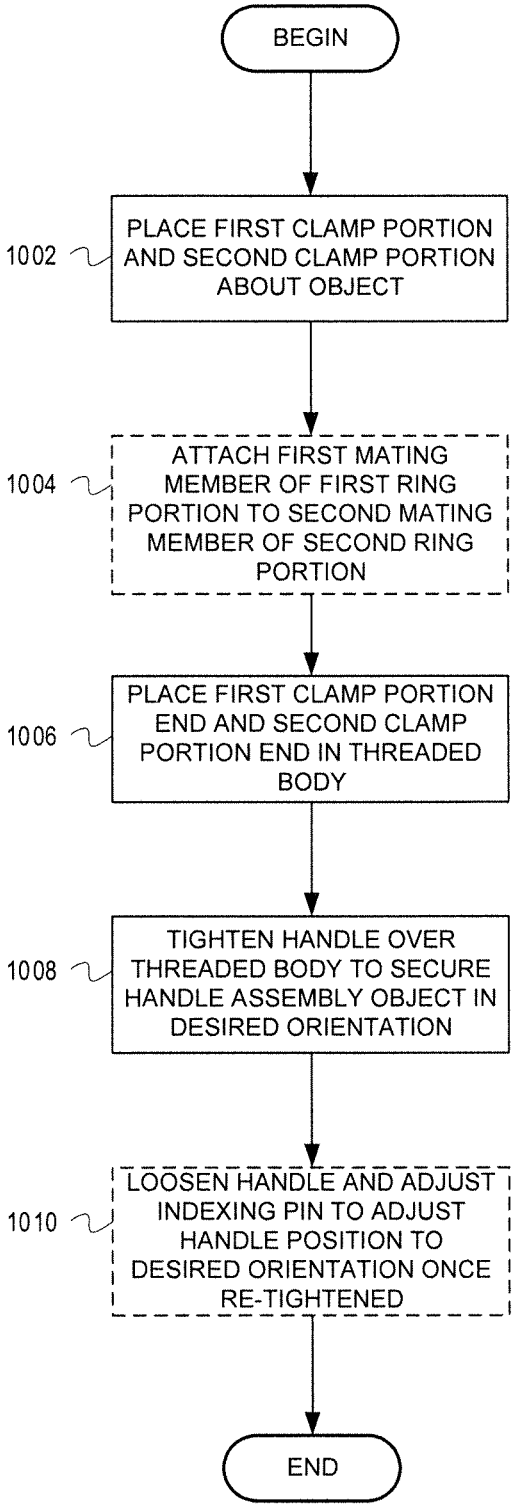
FIG. 10 is a flow diagram depicting example operations for a method of using a handle assembly.
Figure 12:
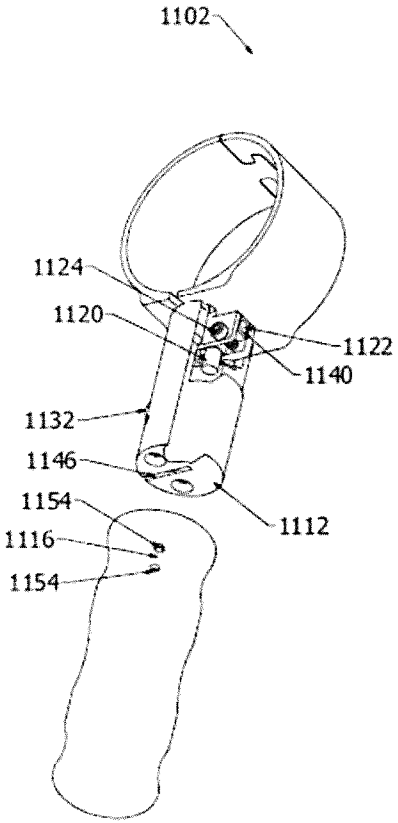
FIG. 12 is an exploded view of the handle assembly 1102 of FIG. 11 illustrating the locking components assembled to the handle assembly but the grip exploded.
Figure 11:
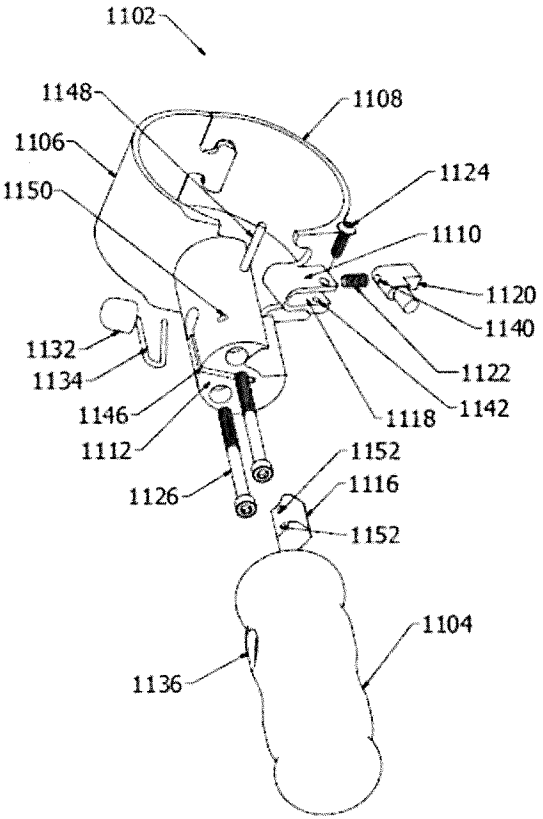
FIG. 11 is an exploded view of an alternate handle assembly 1102 in accordance with some forms of the invention, illustrating the handle grip and locking components exploded from the remainder of the handle assembly.

In FIG. 10, a flow diagram depicting example operations for a method of using a handle assembly is illustrated. In some forms, the flow may being at block 1002 wherein the first clamp member or portion (e.g., first split ring portion) and second clamp member or portion (e.g., second split ring portion) are placed about an object or fixture. For example, the first split ring portion and the second split ring portion can be placed about a cylindrical object such as the fore grip or handguard of a rifle.

At block 1004, a first mating member of the first clamp member or ring portion is attached to a second mating member of the second clamp member or ring portion. For example, the first mating member can be located at an upper portion of the first clamp member or ring portion (i.e., a first end). The second mating member can be located at an upper portion of the second clamp member or ring portion (i.e., a third end) so that the first and second members are connected to one another yet moveable with respect to each other in order to be clamped together around another object.

One advantage of using a split clamp or split ring configuration is that the items can be attached to an object without interfering with other uses of the object. For example, in the rifle handguard application discussed above, the split clamp or split ring configuration allows the clamp or ring assembly to be connected to the fore grip or handguard of the weapon without requiring removal of any accessories mounted on the fore grip or handguard such as Picatinny rails or even accessories mounted on or to such rails such as scopes, laser sights, lights, etc. Conventional handle attachments for weapons typically require removal of such accessories in order to install such a handle which dramatically limits the usefulness of the handle as such items can interfere with the user's ability to reposition the handle as desired and/or makes the handle less attractive as an accessory because of the work required to remove these accessories before installing same.

It should be understood, however, that in alternate embodiments, the clamp members may not be configured as split clamp members or split ring portions and may alternatively be configured as an interconnected or integral piece with ends capable of being clamped together whether by hinge, material make-up (e.g., malleable or flexible materials), or the like. In such instances, flow 1004 is not needed and the flow would simply go from flow 1002 to flow 1006.

At block 1006, the first clamp member or ring portion end and the second clamp member or ring portion end are placed in a threaded body. For example, the first ring portion end can be located at a lower portion of the first ring portion (i.e., a second end). The second ring portion end can be located at a lower portion of the second ring portion (i.e., a fourth end). In yet other forms, however, the first and second clamp or ring portions may actually be threaded themselves or make up at least part of a threaded column so that an outer handle can be tightened over same to exert a clamping force. In some forms at least one of the first and second clamp or ring portions may be tapered so that a clamping force is applied between the clamp members or ring portions when the outer handle is tightened over the first and second clamp or ring portions. This may be done in addition to or in lieu of the clamping configuration discussed above with respect to FIGS. 2-5. For example, in some forms, this form of clamping action may be used in lieu of or in place of the pin assembly 234 configuration discussed in FIGS. 2-5 wherein centering pin 216 forces the clamp members 206 and 208 to clamp together as the outer handle 204 is tightened over threaded body 212.

In still other forms, one of the first or second clamp or ring portions may include (whether integrally formed with or permanently fastened thereto such as by bonding, welding or the like) a threaded portion such as a protrusion that also defines an opening or socket within which the other of the first or second clamp or ring portion is disposed within in order to operate as desired. For example, rather than having the clamp members 206 and 208 in FIG. 2 terminate in free ends 210 and 214, respectively, and then inserted into the threaded body 212 and secured thereto via screws 226, in an alternate form, one of the free ends 210 or 214 could be integrally formed with a threaded protrusion that looks and/or acts like (or performs the same function as) threaded body 212. More particularly, in an alternate embodiment of assembly 202, the threaded body 212 and second clamp member 208 could be formed as an integral piece that defines an opening or socket 228 within which the free end 210 of first clamp member 206 gets disposed in or moved into as outer handle 204 is tightened over the threaded protrusion of second clamp member 208.

Regardless of whether the first and second clamp or ring portions are placed in a threaded body, have external threading themselves or are mate together with one clamp member further defining a threaded portion such as a threaded projection, a handle is preferably tightened over the threading or threaded portion to clamp the members or rings together and secure the handle assembly into a desired orientation on the object to which it is secured. In some embodiments, tightening the handle forces a pin to engage one or more of the first ring portion and the second ring portion. Such engagement causes a clamping force between the first ring portion and the second ring portion, thus securing the handle assembly to the fixture. In other forms, the geometry of the threaded portions may be such (e.g., tapered etc.) that it accomplishes this clamping or assists in causing such clamping action between the first and second clamp members or ring portions.

In prior embodiments, the handle assembly has been designed with a threaded handle that uses rotational movement of the handle to drive a projection, such as a pin, into a mating recess, such as an offset pocket. The opposite configuration is also contemplated (e.g., driving a recess into engagement with a projection). In yet other forms, however, it may be desired to minimize the amount of threading or turning that is needed to be done with the handle to engage the clamping effect of the handle assembly and/or it may be desired to utilize a locking assembly that is more adjustable and/or forgiving to accommodate different size objects to which the handle assembly is to be connected. An exemplary embodiment of an alternate handle assembly that addresses such issues is illustrated in FIGS. 11-14B and referred to generally by reference numeral 1102. In a preferred form, handle assembly 1102 uses a fractional turn locking assembly that requires only small movements of the handle 1104 to engage and lock the handle assembly to an object by clamping first clamp portion or split ring portion 1106 and second clamp portion or split ring portion 1108. In addition, the handle assembly 1102 includes an actuator, such as button 1132, for securing the handle 1104 into a desired position which must be operated in order to release the handle 1104 from the desired or predetermined position. In the form illustrated, the actuator is a push button or depressible button 1132 that mates with a mating recess, such as opening 1136 in handle 1104. In operation, when the handle 1104 is turned a fractional amount (e.g., between 0° and 180° and, in a preferred form, between 20° and 90°, such as about 75°±5°), a first locking structure, such as locking body or block 1116 is rotated into engagement with a second locking structure, such as mating locking protrusion or pin 1120 to clamp first and second ring portions 1106, 1108 together and around whatever object the handle assembly 1102 is being connected to at the moment. In a preferred form, the first locking structure has a cam or cammed surface for moving the second locking structure further to ensure a strong clamping effect between the first and second ring portions 1106, 1108. Further, the handle assembly will include adjustable mechanisms for adjusting one or more of the pin 1120 position and/or block 1116 position in order to make the handle assembly easier to adjust and adjustable to fit different sized items or non-uniform items. In this way, coarse and/or fine adjustments may be made to the handle assembly to allow the user to adjust the handle assembly until a desired performance is reached.

Figure 14A:
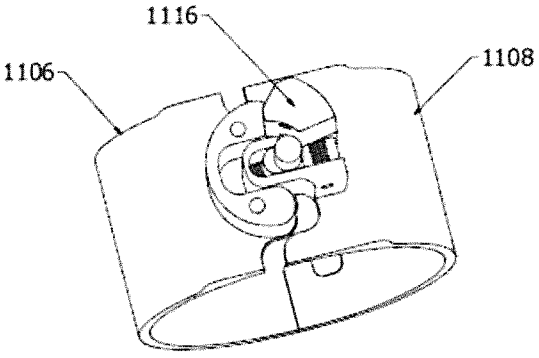
FIG. 14A is an enlarged and partial view of the handle assembly of FIG. 11 illustrating the locking components of the handle assembly in an unlocked position.
Figure 14B:
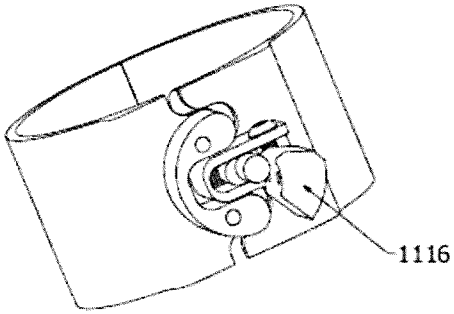
FIG. 14B is an enlarged and partial view of the handle assembly of FIG. 11 illustrating the locking components of the handle assembly in a locked position.
Figure 13B:
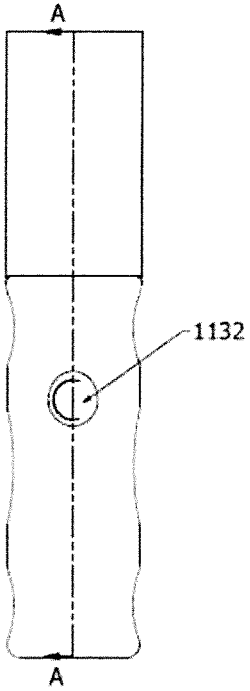
FIG. 13B is a side elevation view of the handle assembly of FIG. 11.
Figure 13A:
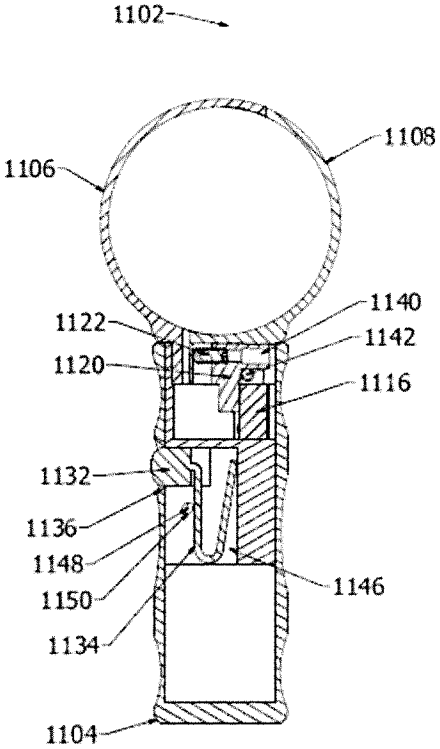
FIG. 13A is a cross-sectional view of the handle assembly of FIG. 13B taken along line A-A and illustrating an optional handle locking actuator for locking the handle in a predetermined position.

Turning now to FIGS. 11, 13, and 14A-B, a more detailed discussion of the operation of the handle assembly 1102 will be provided. As illustrated in these figures, handle assembly 1102 uses a pocket 1118 in split ring portion 1108 to receive a pin block 1120. The wedge block 1116 is attached to the handle 1104 via screw holes 1152 in the wedge block 1116 through handle holes 1154. The handle rotates about the smooth body 1112 which is attached to split ring portion 1106 using bolts 1126. When assembled, the handle can be rotated to bring the wedge block 1116 in contact with the pin block 1120 forcing it to close the gap between split ring portion 1106 and 1108 creating a clamping action. FIG. 14A shows the lock components (e.g., block 1116, pin 1120, etc.) in a first or unlocked position, and FIG. 14B illustrates the lock components in a second or locked position. The pin block 1120 can be adjusted for varying clamp gaps and clamping force by adjusting set screw 1122 which is inserted into pin block threaded hole 1140. Once adjusted for the proper gap and clamp force, the holding screw 1124 which is inserted into hole 1142 can be tightened to lock the pin block 1120 in place.

A handle locking button 1132 locks the handle in place to resist accidental unlocking. The button interacts with handle hole 1136 and uses a spring 1134 to preload the button. The locking button 1132 and spring are assembled into the smooth body 1112 opening 1146 (e.g., slot, recess, etc.) and are retained by pin 1148 inserted into the smooth body hole 1150. As with prior embodiments, body 1112 is connected to first clamping ring portion 1106 via fasteners such as pins 1126. However, as mentioned previously, any connections discussed herein could be made by other means, such as by weld. In some instances items that are currently illustrated as two pieces may be integrated, such as manufacturing such items as a single piece (e.g., a cast piece, stamped piece, etc.).

In the form illustrated, wedge block 1116 corresponds in shape to the shape of the axially oriented slot in smooth body 1112 and is connected to the inside surface of handle 1104 via screws (not shown), which are thread into handle openings 1154 and wedge block openings 1152. During initial assembly, the wedge block 1116 is aligned with the axially oriented slot in smooth body 1112 so that the handle may be moved toward the clamp rings 1106, 1108 and cover the smooth body 1112 and remainder of the locking components of the handle assembly 1102. Once fully installed on the handle assembly 1102, the wedge block 1116 is aligned with a shoulder of the smooth body 1112 (see FIGS. 11 and 13A), which allows the wedge block to travel laterally (transverse and preferably perpendicular to the longitudinal axes of handle 1104 and smooth body 1112 and move between the unlocked position illustrated in FIG. 14A and the locked position of FIG. 14B. Thus, when the handle 1104 is initially installed on smooth body 1112, the wedge block 1116 will be positioned in the position illustrated in FIG. 14A and aligned with the axially oriented slot in smooth body 1112 so that the handle 1104 can be removed from the handle assembly 1102, if desired.

It should be understood, however, that in alternate configurations additional features may be added to the handle assembly 1102 to hinder inadvertent removal of the handle 1104 from the handle assembly 1102. For example, in some forms, a detent, such as a lip, ridge or similar structure, may be positioned either on the internal surface of the axially oriented slot or on the surface of the internal shoulder defined by smooth body 1112 which would have to be overcome in order to either align the wedge block 1116 with the axially oriented slot of smooth body 1112 or remove handle 1104 from handle assembly 1102. In still other forms, a spring may be aligned with the wedge block 1116 and have to be overcome in order to either align the wedge block 116 with the axially oriented slot of smooth body 1112 or remove handle 1104. The term "either" is used in the preceding sentences because in some forms it may be desired to prevent alignment of the wedge block 1116 with the axially oriented slot, while in other forms alignment of the wedge block 1116 with the axially oriented slot may be allowed, but removal of the handle (and thus the wedge block connected to same) is hindered without overcoming the detent or spring force intended to prevent inadvertent removal of the handle 1104 form the handle assembly 1102.

In a preferred form, the components of handle assembly 1102 will be made of metal, however, it should be understood that other materials such as plastics or other polymers may be used to manufacture one or more of the handle assembly components. In addition, in some forms, the handle 1104 may be provided with a grip, such as a surface texture formed in the outer surface of the handle or an additional layer positioned over the exterior of the handle 1104 to grip and rotate the handle 1104 with such a grip. In some forms, an elastomer or other material with a soft texture will be used and will include an ergonomic grip that makes the device easier to use. However, in preferred forms the grip will be ambidextrous to account for the fact that both left hand and right hand persons may use the handle assembly and/or that the handle assembly may be setup to be grabbed with a right hand and/or a left hand (particularly in applications utilizing two handle assemblies, each to be grabbed by on hand).

Thus, in FIGS. 11-14B, an alternate handle assembly 1102 is illustrated that utilizes a fractional turn configuration, a camming lock arrangement to exert clamping force between the locking ring portions 1106, 1108 and/or an actuator 1132 for locking the handle into a desired position. In the form illustrated the actuator 1132 locks the handle in the locked position in order to prevent the handle from inadvertently loosening. More particularly, handle 1104 forms a graspable handle and the actuator 1132 forms a graspable handle lock that is movable between a normally biased locked position that prevents movement of the graspable handle with respect to a remainder of the rotating handle assembly 1102 and an unlocked position wherein the graspable handle is movable with respect to the remainder of the rotating handle assembly 1102.

What is claimed is:

1. A rotatable handle comprising:

a pivotably mounted first clamp member;

a second clamp member connected to the first clamp member on a first end and mating with the first clamp member at a second end;

a rotatable grip extending radially from the first and second clamp members along a longitudinal axis; and a locking structure comprising a locking cam on the rotatable grip, a locking recess on the first clamp member, and a locking protrusion on the second clamp member;

wherein rotation of the rotatable grip about the longitudinal axis causes the locking cam to contact the locking protrusion and push the locking protrusion in a direction substantially perpendicular to the longitudinal axis into the locking recess in order to close a gap between the second end of the first and second clamp members and create a clamping force.

2. The rotatable handle of claim 1, wherein the first clamp member and the second clamp member are connected on the first end via a keyed engagement.

3. The rotatable handle of claim 1 wherein the rotatable grip is a fractional turn handle assembly that includes the locking structure for clamping the first and second clamp members together when moved toward a locked position and releases the first and second clamp members when moved toward an unlocked position.

4. The rotatable handle of claim 1 wherein the rotatable handle further includes a graspable handle lock for locking the rotatable grip into a desired position with respect to a remainder of the rotatable handle, the graspable handle lock being movable between a normally biased locked position wherein movement of the rotatable grip with respect to the remainder of the rotatable handle is prevented and an unlocked position wherein the rotatable grip is movable with respect to the remainder of the rotatable handle.

5. A rotatable handle comprising:

a pivotable first ring portion having a first end and a second end;

a second ring portion having a third end and a fourth end, the third end being connected to the first end of the first ring portion;

a rotatable grip extending radially from the first and second ring portions along a longitudinal axis; and a locking structure comprising a locking cam on the rotatable grip, a locking recess on the first ring portion, and a locking protrusion on the second ring portion;

wherein rotation of the rotatable grip about the longitudinal axis causes the locking cam to contact the locking protrusion and push the locking protrusion in a direction substantially perpendicular to the longitudinal axis into the locking recess in order to close a gap between the second end of the first ring portion and fourth end of the second ring portion and create a clamping force.

6. The rotatable handle of claim 5, wherein the third end of the second ring portion and the first end of the first ring portion are connected via a keyed engagement.

7. The rotatable handle of claim 5, wherein the first ring portion and the second ring portion are curved to clamp around a rounded object to which the rotatable handle is connected.

8. The rotatable handle of claim 7, wherein the rotatable handle is clamped into a fixed position with respect to the rounded object after the rotatable grip is rotated.

9. A rotatable handle assembly comprising:

a pivotable first clamp member;

a second clamp member connected to the first clamp member on a first end and mating with the first clamp member at a second end;

a fractional turn handle extending radially from the first and second clamp members along a longitudinal axis and movable between a first handle position wherein the first clamp member is in a secured position and a second handle position wherein the first clamp member is in an unsecured position; and a locking structure comprising a locking cam on the fractional turn handle, a locking recess on the first clamp member, and a locking protrusion on the second clamp member;

wherein the fractional turn handle is movable from the first handle position to the second handle position by rotating the fractional turn handle about the longitudinal axis thereof by less than 180°, and wherein the first clamp member is moved between the secured position and the unsecured position by the rotation of the fractional turn handle;

wherein rotation of the fractional turn handle about the longitudinal axis from the second handle position to the first handle position causes the locking cam to contact the locking protrusion and push the locking protrusion in a direction substantially perpendicular to the longitudinal axis into the locking recess in order to close a gap between the second end of the first and second clamp members and create a clamping force.

* * * * *